United States Patent [19]

Gerhard

[11] Patent Number: 5,064,091

[45] Date of Patent: Nov. 12, 1991

[54] SWAP TANK

[75] Inventor: Helmut Gerhard, Weitefeld, Fed. Rep. of Germany

[73] Assignee: Westerwaelder Eisenwerk Gerhard GmbH, Fed. Rep. of Germany

[21] Appl. No.: 567,055

[22] Filed: Aug. 14, 1990

[30] Foreign Application Priority Data

Aug. 14, 1989 [DE] Fed. Rep. of Germany ... 8909771[U]

[51] Int. Cl.[5] ..... B65D 90/12

[52] U.S. Cl. ..... 220/628; 220/1.5; 220/562; 220/4.14; 220/631

[58] Field of Search ..... 220/1.5, 562, DIG. 24, 220/4.14, 4.12, 628, 631; 248/146, 346

[56] References Cited

U.S. PATENT DOCUMENTS

| | | | |
|---|---|---|---|
| 2,952,380 | 9/1960 | Hampton et al. | 248/146 |
| 3,339,499 | 9/1967 | Charles et al. | 220/562 |
| 3,726,431 | 4/1973 | Botkin | 220/1.5 |
| 3,730,384 | 5/1973 | Ramme | 220/562 |
| 3,971,491 | 7/1976 | Mowatt-Larssen et al. | 220/628 |
| 4,441,678 | 4/1984 | Dorpmund | 220/1.5 |
| 4,591,064 | 5/1986 | Gerhard | 220/1.5 |
| 4,603,788 | 8/1986 | Gerhard | 220/1.5 |
| 4,753,363 | 6/1988 | Gerhard | 220/4.12 |
| 4,905,854 | 3/1990 | Gerhard | 220/1.5 |
| 4,955,956 | 9/1990 | Gerhard | 220/562 |

FOREIGN PATENT DOCUMENTS 3743670 7/1989 Fed. Rep. of Germany ..... 220/1 R

*Primary Examiner*—Stephen Marcus
*Assistant Examiner*—S. Castellano
*Attorney, Agent, or Firm*—Evenson, Wands, Edwards, Lenahan & McKeown

[57] ABSTRACT

A swap tank has transverse bars disposed at the standard spacing of ISO containers and end portions extending beyond the transverse bars. Each end portion has associated with it a base frame structure including the transverse bar and a pair of diagonal struts which extend towards each other and are welded together at the tank end. A support member is welded between the interconnected ends of the diagonal struts and a ring welded to the tank bottom below the tank axis. The support member is formed as an integral bent sheet metal part having two lateral triangular wall elements. To compensate for manufacturing tolerances, the support member may be adjusted by varying the bending angle in such a manner that the free edges of the triangular wall elements extend parallel and flush with the outwardly facing surface of the ring and may be welded thereto. A structure is thus obtained which not only protects the projecting tank end but also serves to transmit longitudinal acceleration forces from the tank bottom into the corner fittings provided at the ends of the transverse bar.

11 Claims, 2 Drawing Sheets

SWAP TANK

BACKGROUND OF THE INVENTION

ISO containers are standardized with respect to their dimensions and are provided with corner fittings at all of their corners. Corresponding locking members such as pins or twist-locks are disposed at predetermined spacings on platforms of container transport vehicles. The largest ISO containers have a length of 40 ft. (12192 mm).

For the transport of low-density materials such as gases including pressure-liquified gases, more recent draft standards (such as the draft CEN Swap Tank Euro Standard) provide for—normally symmetrical—extensions of the tank beyond the standard length of the base frame structure, which is standardized at 20 ft. (6058 mm), 30 ft. (9125 mm) or 40 ft. (12192 mm) for ISO containers. In order to secure such extended tanks on the available vehicle platforms, the transverse bars provided with corner fittings are maintained at their standard spacing and the tank symmetrically projects beyond these transverse bars. In many cases, a manhole concentric with respect to the tank axis is disposed in the tank bottom on one of the projecting end regions.

For protecting the tank end regions including any manhole armatures that may be provided there, it has been known to dispose attachments outside the transverse bars which slightly project beyond the tank in the longitudinal direction thereof and are formed of bent tubes like railings or include straight bars and struts that may be interconnected by means of additional outer ISO corner fittings. Such attachments may further be reinforced by disposing two such structures above each other.

U.S. Pat. No. 4,603,788 discloses a swap tank which comprises a cylindrical main portion having curved tank bottoms, base frame structures associated to the tank ends and each including a transverse bar and a pair of diagonal struts extending from the ends of the transverse bar towards each other, and two saddle arrangements each including a support member disposed between the tank bottom and the associated base frame structure. The end regions of the tank are thus provided with structures that transmit the forces exerted on the tank to support and engagement points (corner fittings) of transverse bars provided at the tank ends. The document, however, describes a tank which is sized to fall completely within the standard dimensions, each the end frame being each provided with four corner fittings defining the outer dimensions of a tank container.

German Offenlegungsschrift 3,714,396 further discloses a connection between the tank and framework of a tank container which includes two parallel and somewhat triangular sheet metal pieces. Otherwise however the known design is quite dissimilar from the present invention as regards both the underlying object and the structure meeting that object.

SUMMARY OF THE INVENTION

It is an object of the present invention to provide a swap tank which has end regions projecting beyond the bottom transverse bars and is provided with a structure which not only protects the projecting end regions but also assists in introducing any longitudinal and transverse forces exerted on the tank into the ends of the transverse bars which form the regular support and engagement points of the overall tank structure.

This object is met by a swap tank comprising a cylindrical main portion defining a tank axis and having a pair of curved tank ends, a pair of base frame structures associated with said tank ends and each including a transverse bar and a pair of diagonal struts extending from the ends of said transverse bar toward said tank end and being interconnected in the region of said tank end, and a pair of saddle arrangements each including a support member disposed between one of said tank ends and the associated base frame structure and including a pair of triangular wall elements extending at an angle with respect to each other, each of said triangular wall elements having a first edge connected to the first edge of the respective other triangular wall element, a second edge connected to a corresponding diagonal strut, and a third edge connected to the respective tank end.

The invention thereby provides not only a lower anti-buffing structure supported by the tank, but achieves the additional advantage that not only transverse forces are transmitted from the main tank portion via usual direct supports to the transverse bar but also longitudinal acceleration forces occurring during braking and starting operations are introduced from the lower part of the tank bottom via a support member and two diagonal struts into the ends of the transverse bar.

Since the support member is formed of two triangular wall elements extending at an angle with respect to each other, varying this angle will permit an adjustment of the inclination of the edges facing the tank bottom relative to the area where the support member is attached to the tank bottom. As a result, the support member can be fitted between a prefabricated base frame structure and a corresponding tank end or bottom irrespective of manufacturing tolerances and may be connected to the tank bottom in a low-stress manner. As a result, the invention provides a structure with excellent supporting and forcetransmitting characteristics, yet constituting a lightweight part that is easy to install.

In a preferred embodiment of the invention, the support member is formed by an integral bent sheet metal part, the two triangular wall elements being interconnected by a rectangular wall element extending essentially transverse of the tank axis. The support member is thus formed by particularly uncomplicated structural part which allows adjusting the angle between the two triangular surface portions by a simple bending operation.

In a further advantageous development, a bearing member that may be constituted by an open ring of T-shaped cross-section is disposed between the tank end and said support member, the bearing member having an annular edge welded to the tank end eccentrically below said tank axis and an outer end face for connection to said support member. This configuration results in an even better distribution of the forces to be transmitted between the tank bottom and the support member. The closed circular weld will avoid peak stresses and provide a plane connecting surface that enables a flaw-less weld connection with even the straight edges of the triangular surface elements.

Further optional features of the invention are related to supporting and force-transmitting measures and to protecting the projecting tank end portions Additional outer corner fittings provided in accordance with still further embodiments of the invention render the overall tank more flexible with respect to securing it to pins or twistlocks provided on a vehicle platform.

DETAILED DESCRIPTION OF PREFERRED EMBODIMENTS

Figure 1:
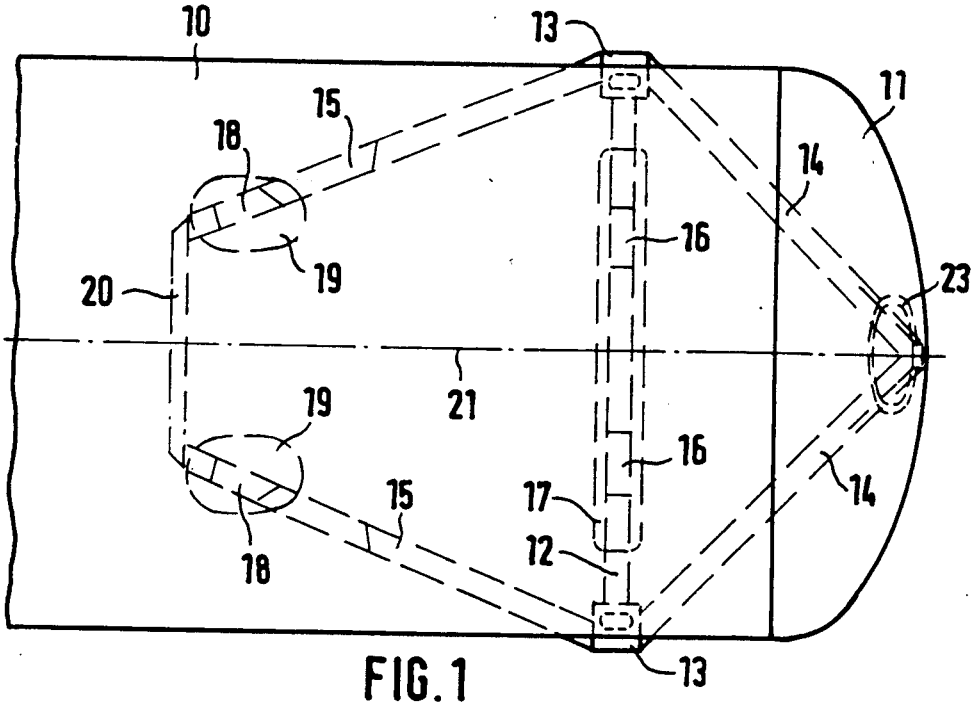
FIG. 1 is a schematic plan view showing an end portion of a swap tank.
Figure 2:
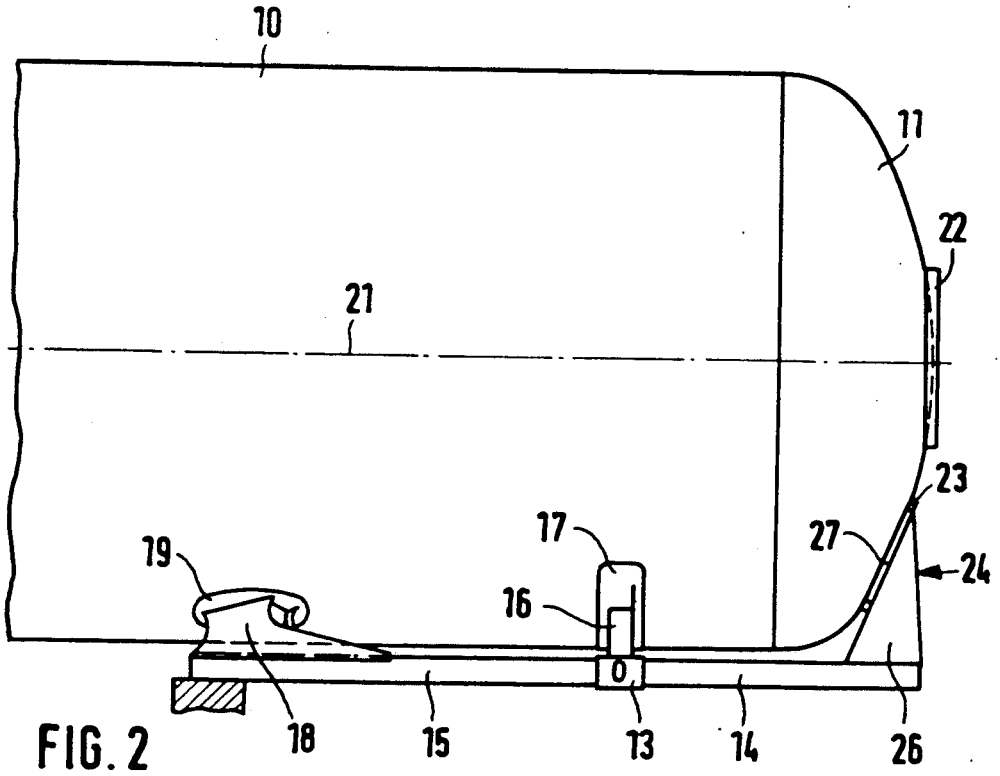
FIG. 2 is a side view of the tank shown in FIG. 1.
Figure 3:
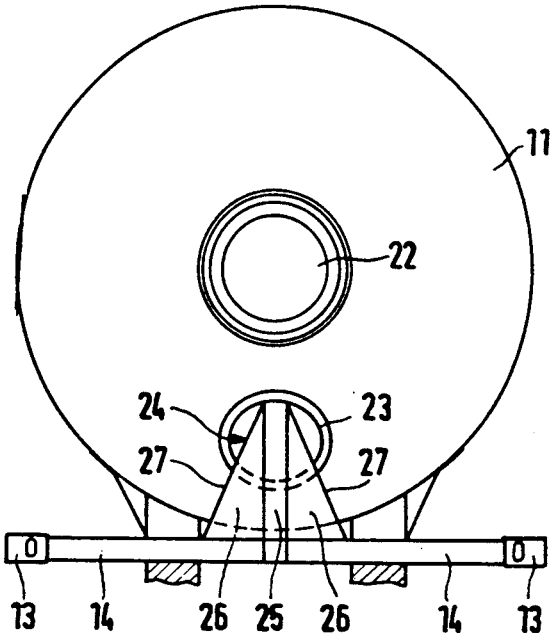
FIG. 3 is an end view as seen from the right in FIG. 2.

As shown in FIGS. 1 to 3, the swap tank includes a cylindrical main portion 10 having curved tank bottoms 11 (only one of which is seen).

Each tank bottom has an associated base frame structure comprising a transverse bar 12 provided with ISO corner fittings 13 and its ends, a pair of diagonal struts 14 extending from the corner fittings 13 towards each other in the direction of the tank end, and a pair of diagonal bars 15 extending from the corner fittings 13 in the opposite direction and towards each other. The outermost ends of the diagonal struts 14 are interconnected by welding and together with the transverse bar 12 form a triangular partial frame.

The transverse bar 12 is connected to the lower side of the tank main portion 10 by vertical supports 16, preferably of the structure known from DE-A-3 624 430. In the area where the supports 16 are connected to the tank envelope the latter is reinformed by a reinforcing plate 17.

The inner ends of the diagonal bars 15 facing away from the tank end are also connected to the lower side of the tank main portion 10 by further supports 18, the tank main portion 10 being again provided with a reinforcing plate 19 in the area where it is connected to the supports 18. For further reinforcement of the base frame structure, the inner ends of the two diagonal bars 15 are interconnected by a transverse member 20.

The tank bottom 11 shown in FIGS. 2 and 3 is provided with a manhole 22 disposed symmetrically and thus coaxially to the tank axis 21. (The manhole 22 is not shown in FIG. 1 for simplification of the drawing.)

An angular or L-section ring 23 is provided below the manhole 22 and thus eccentrically below the tank axis 21. The peripheral edge of the ring 23 is welded to the tank bottom 11, so that the flange remote from the tank forms a plane annular surface. The open ring 23 shown may be replaced by a flat cylindrical element having a closed end and being provided with a venting and dewatering opening.

A support member 24 is inserted between the ring 23, which serves as a bearing member, and the interconnected ends of the diagonal struts 14. The support member 24 is formed as an integral bent sheet metal part having a central, narrow, rectangular wall element 25 and two lateral triangular wall elements 26.

As shown in FIG. 2, the central wall element 25 extends almost vertically and is inclined at a small angle with respect to a plane perpendicular to the tank axis 21. The two lateral triangular wall elements 26 are bent with respect to the central wall element 25 towards the tank in such a manner that their free edges 27 are flush with the plane constituted by the ring 23.

Such a flush abutment can always be achieved by varying the bending angle between the triangular wall elements 26 and the central wall elements 25, thereby compensating for tolerances in the shape of the tank bottom 11, the mounting position of the ring 23 and the shape of the support member 24 itself. Given roughly accurate shapes, the said angle will be always in such a range that the lower edges of the support member 24 along their entire lengths will lie within the width of the diagonal struts 14.

During assembly, one ring 23 will first be welded to each tank bottom 11 with the closed annular weld being advantageous to avoid peak stresses. The two base frame structures are then prepared and disposed relatively to each other with the prescribed longitudinal spacing between the corner fittings provided at the two transverse bars 12. Subsequently, the tank is placed on the supports 16 and 18 of the base frame structures and welded thereto. In a final mounting step, support members 24 are inserted and shaped by adapting the abovementioned angle so as to permit welding of the edges 27 to the rings 23 and of the lower edges to the diagonal struts 14.

Alternatively, the lower ends of the two triangular wall elements 26 may be overlap-welded to the vertical flanges of the diagonal struts 14, which in this case must have a corresponding cross-sectional shape. In this case, the angular adaptation may require a certain spacial distortion of the wall elements 26.

Figure 5:
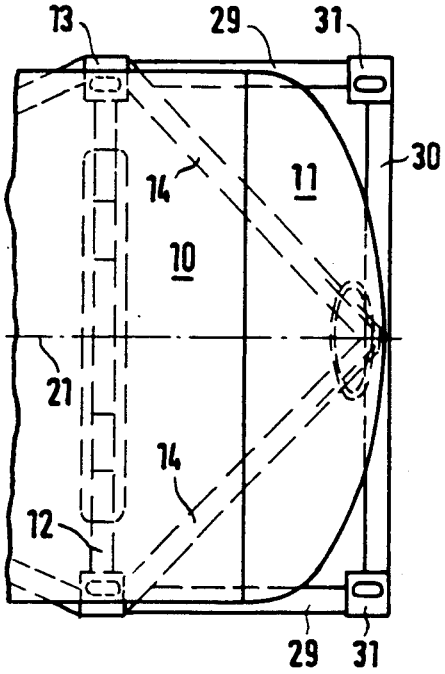
FIGS. 4 and 5 are views similar to FIG. 1 showing modifications of a swap tank.
Figure 4:
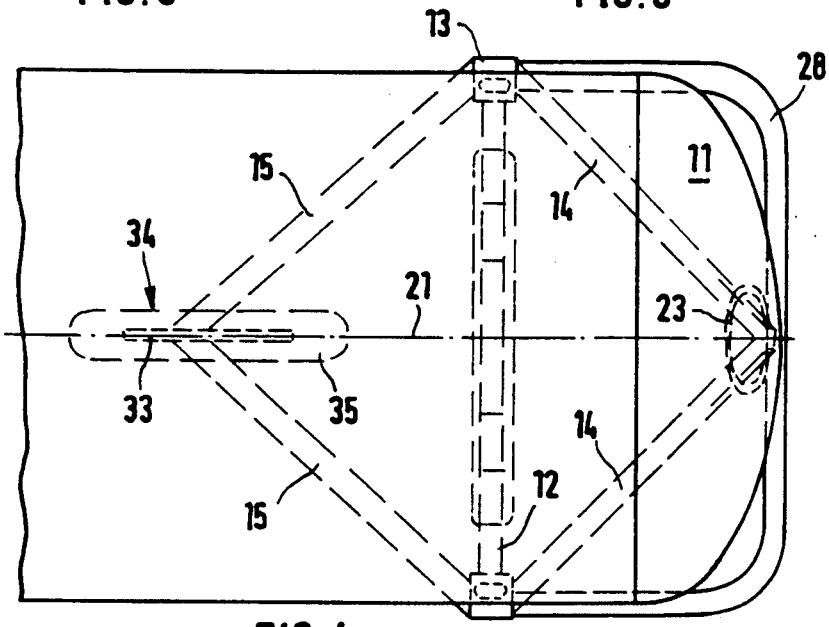

The embodiments of the swap tank according to FIGS. 4 and 5 differ from that of FIGS. 1 to 3 by being provided with an additional frame portion which is attached to the corner fittings 13, slightly extends in the longitudinal direction beyond the tank end to form an anti-buffing protection, and is connected to the outer ends of the diagonal struts 14. In FIG. 4, this frame portion is shaped as a one-piece curved bracked 28.

FIG. 4 further shows a connection between the diagonal bars and the lower portion of the tank modified over that of FIG. 1. In FIG. 4, the inner ends of the diagonal bars 15 are welded to both sides of the vertical web 33 of a short T-bar 34 which has its horizontal flange 35 supporting the tank main portion 10. The horizontal flange 35 is welded to the tank along its entire outer edge which is rounded at its ends to avoid peak stresses.

In the modification of FIG. 5, the frame portion extending beyond the tank bottom 11 consists of two longitudinal bars 29 connected to the corner fittings 13 and an outer transverse strut 30 welded to the ends of the diagonal struts 14. The transverse strut 30 and the longitudinal bars 29 are interconnected by respective further corner fittings 31, which in this embodiment offer a further possibility of securing the swap tank to locking members on the respective transport platform.

I claim:

1. A swap tank comprising:

a cylindrical main portion defining a tank axis and having a pair of tank ends, a pair of base frame structures associated with said tank ends and each including a transverse bar and a pair of diagonal struts extending from the ends of said transverse bar toward said tank end and being interconnected in the region of said tank end, and a pair of saddle arrangements each including a support member disposed between one of said tank ends and the associated base frame structure and including a pair of triangular wall elements extending at an angle with respect to each other each of said triangular wall elements having a first edge connected to the first edge of the respective other triangular wall element, a second edge extending substantially parallel to a corresponding diagonal strut and being connected thereto, and a third edge connected to the respective tank end.

2. The swap tank of claim 1, wherein said pair of triangular wall elements is formed by an integral bent sheet metal part.

3. The swap tank of claim 1, wherein the two triangular wall elements are interconnected by a rectangular wall element extending essentially transverse of said tank axis.

4. The swap tank of claim 1, including a bearing member disposed between the tank end and said support member, the bearing member having an annular edge welded to the tank end eccentrically below said tank axis and an outer end face for connection to said support member.

5. The swap tank of claim 4, wherein said bearing member is formed as an open ring of T-shaped cross-section.

6. The swap tank of claim 1, wherein the ends of said transverse bar are connected to said tank main portion by means of two diagonal bars extending towards each other in the direction of the opposite tank end.

7. The swap tank of claim 6, including a T-bar having a vertical web and a horizontal flange, the inner ends of said diagonal bars being welded to both sides of said vertical web and said horizontal flange supporting said tank main portion.

8. The swap tank of claim 1, wherein said transverse bar is connected to said tank main portion via a support arrangement extending transverse of said tank axis.

9. The swap tank of claim 1, wherein the ends of said transverse bar are interconnected by a frame portion which, in the direction of said tank axis, extends beyond the tank end and is connected to the outer ends of said diagonal struts.

10. The swap tank of claim 9, wherein said frame portion is formed as a one-piece curved bracket.

11. The swap tank of claim 9, wherein said frame portion includes an outer transverse strut provided with corner fittings and connected to said transverse bar by longitudinal bars.

* * * * *